United States Patent [19]

Brock, Jr.

[11] 4,125,155

[45] Nov. 14, 1978

[54] TUBING HANGER WITH FAIL-SAFE CONTROL PASSAGEWAY

[75] Inventor: Bill M. Brock, Jr., Stafford, Tex.

[73] Assignee: NL Industries, Inc., New York, N.Y.

[21] Appl. No.: 831,583

[22] Filed: Sep. 8, 1977

[30] Foreign Application Priority Data

Sep. 17, 1976 [GB] United Kingdom ..... 38730/76

[51] Int. Cl.[2] ..... E21B 33/03

[52] U.S. Cl. ..... 166/97; 166/85; 166/319; 166/87

[58] Field of Search ..... 166/86, 87, 88, 89, 166/97, 85, 319

[56] References Cited

U.S. PATENT DOCUMENTS

| | | | |
|---|---|---|---|
| 3,273,646 | 9/1966 | Walker | 166/89 |
| 3,324,951 | 6/1967 | Balmer et al. | 166/87 |
| 3,468,559 | 9/1969 | Ahlstone | 166/87 |
| 3,814,179 | 6/1974 | Hull, Jr. | 166/89 |

*Primary Examiner*—Ernest R. Purser
*Attorney, Agent, or Firm*—Fulbright & Jaworski

[57] ABSTRACT

A tubing hanger supported in a wellhead and in turn supporting tubing therefrom, and having an upper end adapted to be engaged by a Christmas tree. The hanger includes an annulus control passageway extending between the annulus between the tubing and casing and the Christmas tree and includes one or more safety valve control passageways for controlling subsurface safety valves. Valves are connected to each of the passageways for opening and closing the passageways with springs urging the valves to a closed position whereby the passageways will be closed when the tubing hanger is installed so that the well is completely closed when the tubing hanger is landed. The valves are exposed to the exterior of the hanger whereby the valves may be actuated to an open position by mechanical and/or hydraulic controls connected to the Christmas tree.

9 Claims, 6 Drawing Figures

TUBING HANGER WITH FAIL-SAFE CONTROL PASSAGEWAY

BACKGROUND OF THE INVENTION

Generally, when an oil and/or gas well is drilled, a blowout preventer is utilized to protect the well to contain the well fluids in the well. However, after a tubing hanger and tubing is installed in the well preparatory to obtaining protection from the well, the blowout preventer is removed and replaced with a Christmas tree having the necessary protective valves for closing off the well. Therefore, during the period after the removal of the blowout preventer and before securing the Christmas tree, the well is subjected to a period of time when adequate protection for containment of the well fluid is unavailable.

The present invention is directed to a tubing hanger which, when installed, will completely shut in the well and reduce the critical time that the well is left unprotected during the replacement of the blowout preventer by a Christmas tree.

SUMMARY

The present invention is directed to a tubing hanger supported in a wellhead with the lower end of the hanger adapted for supporting tubing therefrom and an upper end adapted to be engaged by a Christmas tree. The hanger includes a plurality of control passageways and valve means are connected to the passageways for opening and closing the valve means. Yieldably urging means are connected to the valve means for normally moving the valve means to a closed position whereby the passageways will be closed while the tubing hanger is installed in a wellhead. The valve means are exposed to the exterior of the hanger whereby the valve means may be actuated to an open position by means connected to the Christmas tree for re-establishing fluid control of the well.

Yet a still further object of the present invention is the provision of valve means extending exteriorly of the Christmas tree for contact by and automatic mechanical actuation by the Christmas tree.

Still a further object of the present invention is the provision of valve means including a piston for actuation by fluid control means connected to the Christmas tree.

Still a further object of the present invention is the provision wherein the valve means and yieldable urging means include an annular sleeve surrounding the hanger and a spring urging the sleeve to a closed position for closing the passageways.

Yet a still further object of the present invention is the provision of a tubing hanger having an annulus control passageway communicating between the annulus between the tubing and the casing and the Christmas tree, and one or more safety valve control passageways for controlling one or more subsurface safety valves in which valve means are connected to each of the passageways for closing the passageways when the tubing hanger is landed and blocked into for closing the well in while the blowout preventer is being replaced with a Christmas tree.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

Figure 4:
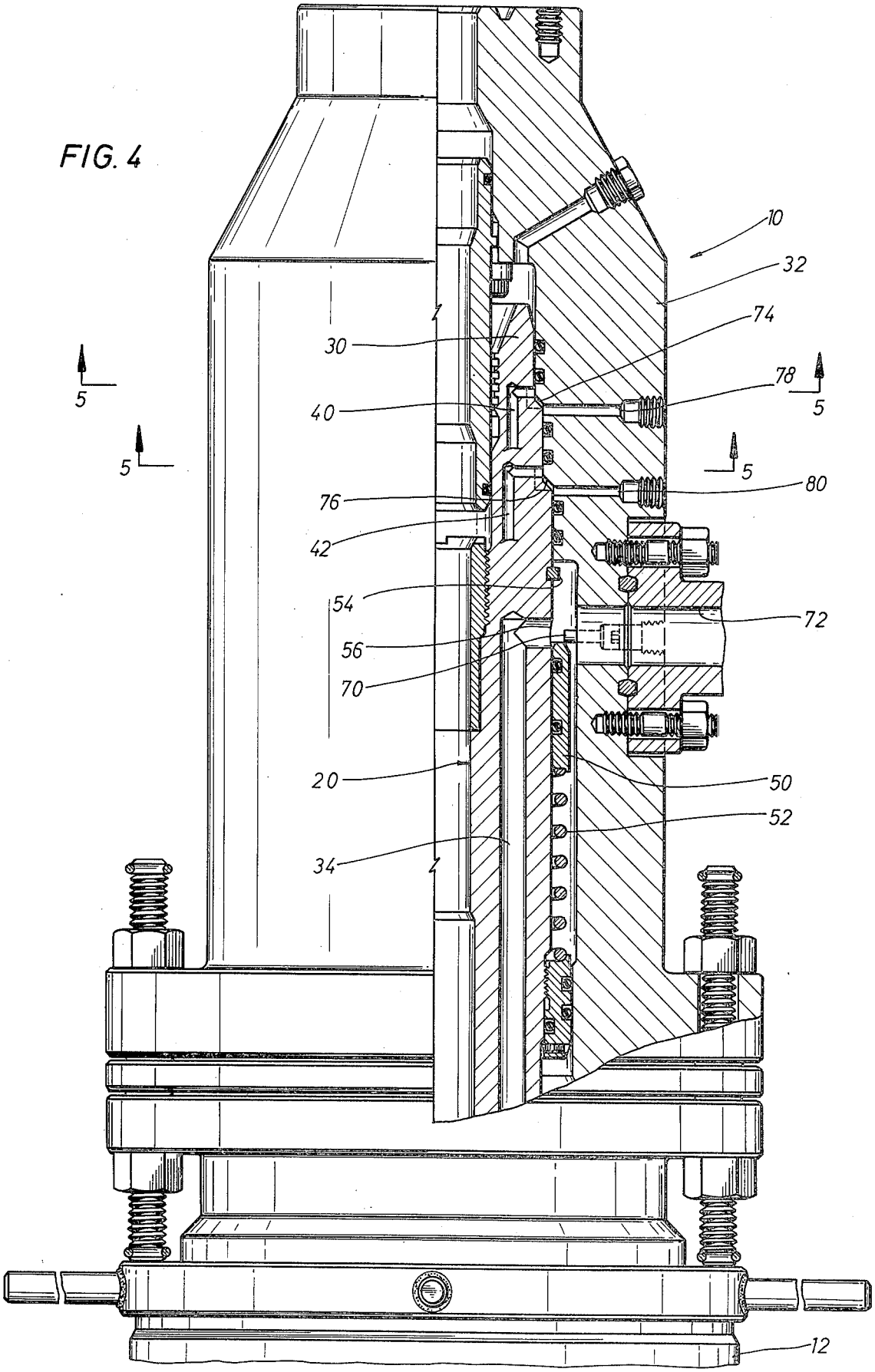
FIG. 4 is an elevational view, partly in quarter section, of a modified embodiment of the tubing hanger of the present invention installed in a wellhead.

Referring to the drawings, and particularly to FIG. 4, the reference numeral 10 generally indicates a well assembly of the present invention which generally includes a wellhead 12 supporting a casing hanger (not shown) therein. All of the above-described equipment is conventional. The tubing hanger of the present invention is generally indicated by the reference numeral 20 which is conventionally supported in the wellhead 12 such as from a casing hanger for supporting tubing therebelow and has an upper end 30 adapted to be engaged by the lower end 32 of a Christmas tree. The tubing hanger 20 also includes a plurality of control passageways such as an annulus control passageway 34 which is in communication between the annulus (not shown) between the well tubing and the well casing and extends exteriorly of the tubing hanger 20, and one or more safety valve control passageways 40 and 42 which extend from the exterior of the upper end 30 of the tubing hanger 20 and through the bottom of the tubing hanger 20 to subsurface safety valves (not shown) which are connected to the tubing (not shown) as is conventional. The conventional subsurface safety valves control the flow of fluid through the interior of the well tubing when they are in a closed position and open only when hydraulic control fluid is supplied through the control passageways 40 and 42. Thus, the tubing hanger 20 of the present invention when installed in the casing hanger 18 controls all of the openings extending downwardly into the well. The tubing hanger 20 is installed through an uphole blowout preventer (not shown) and thus the well is under the safety protection of the blowout preventer while the tubing hanger 20 is being placed in position.

Figure 5:
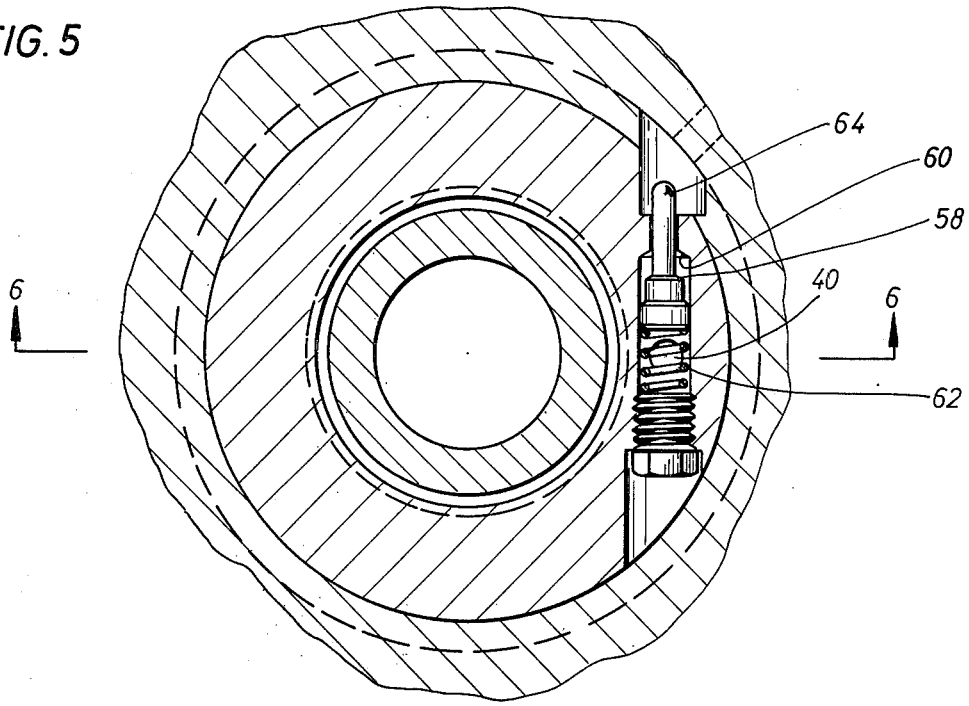
FIG. 5 is a cross-sectional view taken along the lines 5—5 of FIG. 4.
Figure 6:
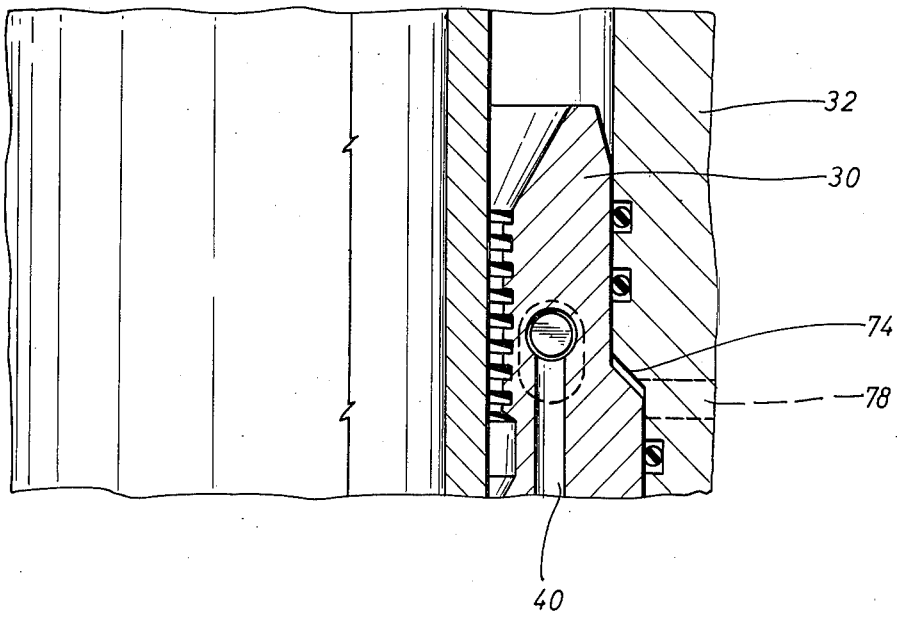
FIG. 6 is a cross-sectional view taken along lines 6—6 of FIG. 5.

Each of the control passageways 34, 40 and 42 includes suitable valve means for initially closing the passageways 34, 40 and 42 so that when the tubing hanger 20 is installed the openings to the well will be completely closed by the tubing hanger 20. The valve means for closing the passageways 34, 40 and 42 may be of any suitable type. One such valve is here shown as a sleeve valve 50 surrounding the exterior of the tubing hanger 20 and yieldably urged by a spring 52 against a stop 54 whereby the sleeve valve 50 will cover the entrance 56 of the annulus passageway 34. The valves closing passageways 40 and 42, are best seen in FIG. 5, and may be a conventional dill valve having a valve element 58 which is urged against a seat 60 by a spring 62. Thus, the valves 50 and 60 normally close the passageways 34, 40 and 42. It is also noted that the valves 50 and 60 are exposed to the exterior of the hanger 20 whereby the valves 50 and 60 may be actuated to the open position. That is, sleeve valve 50 is positioned on the exterior surface of the tubing hanger 20 and the dill valves 60 include a projection 64 which extends outwardly from the periphery of the tubing hanger 20.

As has previously been discussed, the tubing hanger 20 is installed into place in the wellhead 12 on the casing hanger 18 through an uphole blowout preventer and as installed the valves 50 and 60 are in the closed position blocking the passageways 34, 40 and 42 as well as the interior 44 of the tubing 28 by the action of subsurface safety valves. Therefore, the tubing hanger 20 protects the well by keeping it closed as the blowout preventer is removed and the tree connection is connected to the wellhead 12 and the tubing hanger 20.

The tree connector 32 includes means for actuating the valves 50 and 60 to the open position. Thus, the tree 32 may include a threaded pin 70 which engages the top of the valve 50 as the tree connector is slid over the top 30 of the tubing hanger 20 thereby pushing the valve 50 against the spring 52 and opening the entrance to the annulus control passageway 34. The tree connector 32 may also include a passageway 72 which thereby comes in communication with the annulus passageway 34 and is suitably extended uphole (not shown) for suitable control and monitoring. The tree connector 32 also includes shoulders 74 and 76 which engage the ends 64 of the valves 60 thereby moving the valve elements 58 against the springs 62 to open the passageways 40 and 42. In addition, the tree connector 32 includes fluid passageways 78 and 80 which are then placed in communication with the safety valve control passageways 40 and 42, respectively, and are connected to fluid lines (not shown) which extend to the well surface for actuating and controlling subsurface safety valves. After the tree connector 32 is slipped over the upper end 30 of the tubing hanger 20, it is secured to the wellhead 12 and thereafter functions to control fluid flow from the well.

Figure 1:
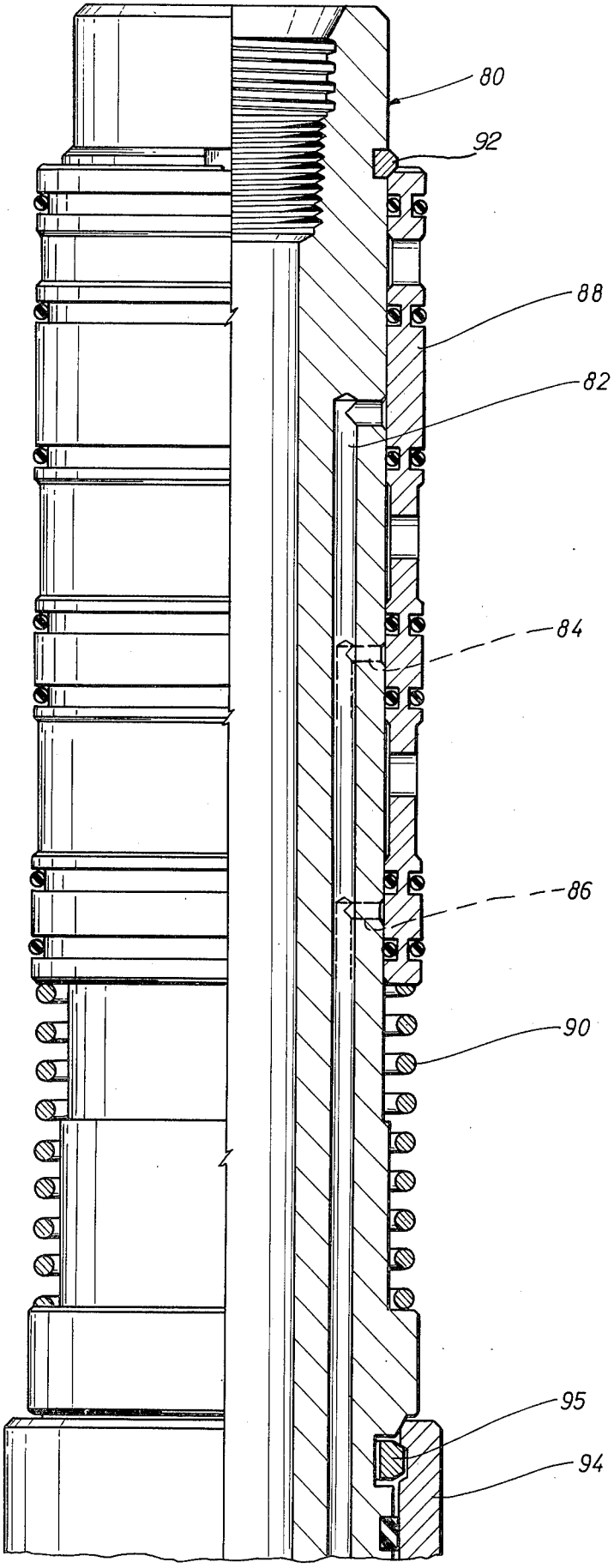
FIG. 1 is an elevational view, partly in quarter section, of a tubing hanger being installed in the wellhead with all of the control passages closed.
Figure 2:
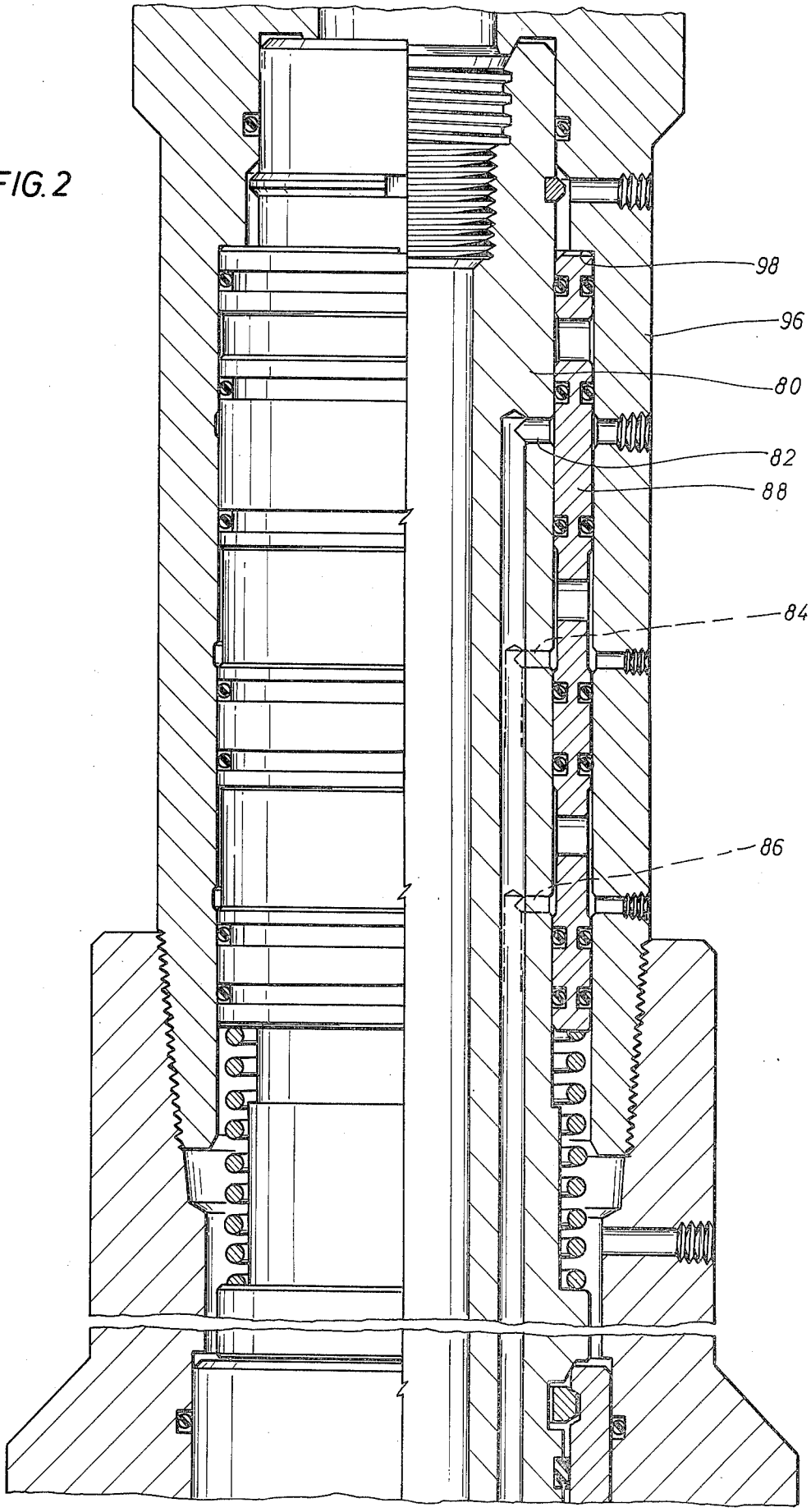
FIG. 2 is an elevational view, partly in quarter section, illustrating the apparatus of FIG. 1, with the tree connector installed and automatically mechanically moving the valve means to open up some of the passageways while leaving other passageways closed.
Figure 3:
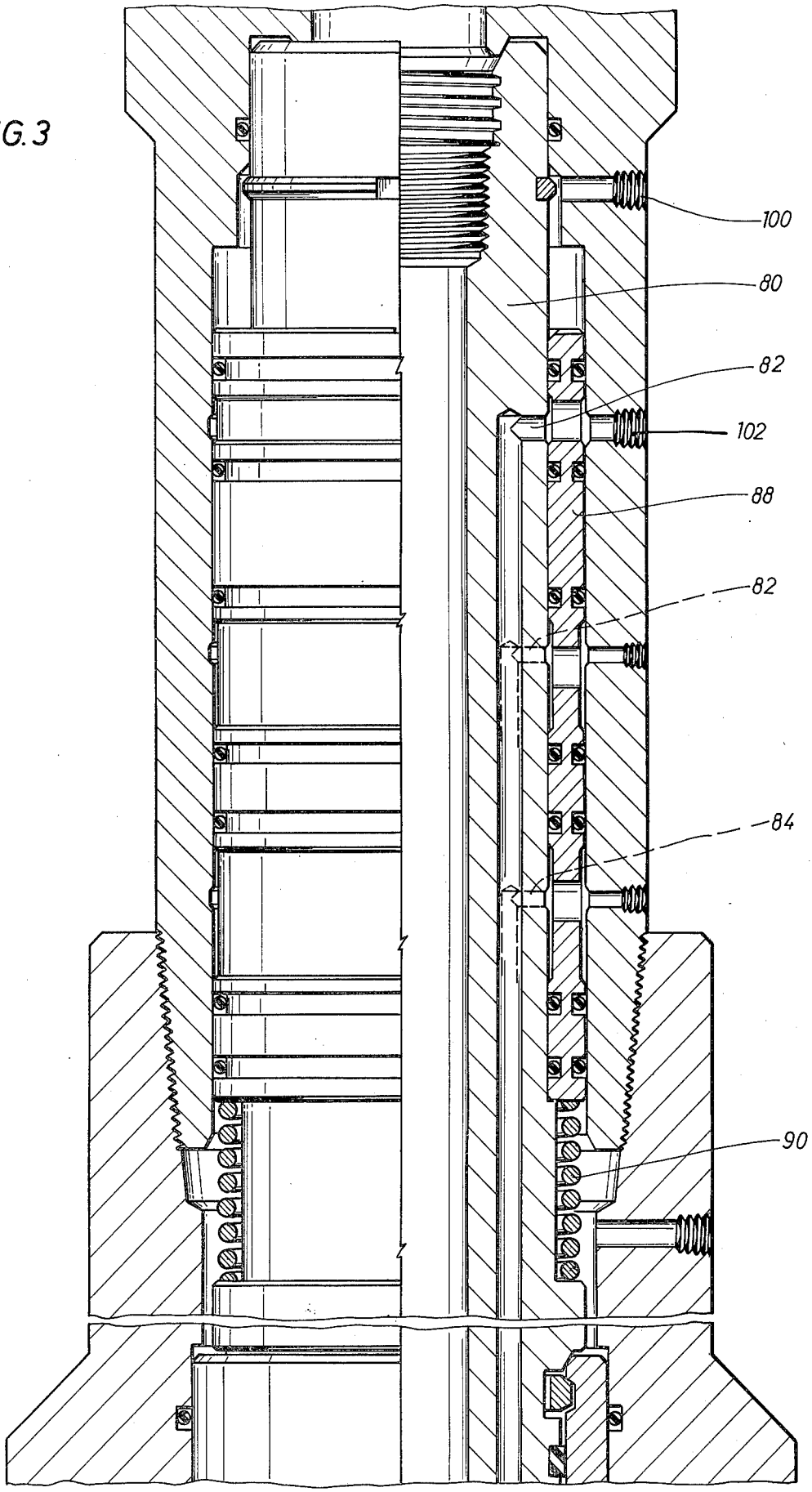
FIG. 3 is an elevational view, partly in quarter section, similar to FIG. 2 in which hydraulic fluid has been applied through a port in the tree connector for moving the valve means to open all of the tubing hanger passageways.

Referring now to FIGS. 1, 2 and 3, another embodiment of the invention is shown in which the tubing hanger generally indicated by the reference numeral 80 includes a plurality of control passageways such as annulus control passageway 82 and subsurface control valve passageways 84 and 86. A sleeve valve 88 is provided on the exterior of the tubing hanger 80 and is urged to a closed position by spring 90 and against a top 92 for sealing and closing off all of the passageways 82, 84 and 86 when the tubing hanger 80 is secured into a wellhead 94. Therefore, in the posotion shown in FIG. 1 when the tubing hanger 80 is landed in the head 94 and locked therein by latch 95, all of the passageways 82, 84 and 86, as well as the tubing bore, is shut in and it is safe to remove the blowout preventer protection.

In FIG. 2, the Christmas tree connector 96 has been installed over the tubing hanger 80 and a shoulder 98 engages the top of the sleeve valve 88 and moves it downwardly against the action of the spring 90 to open the safety valve passageways 84 and 86 so that the subsurface safety valve can function in their normal manner. However, it is noted that partial actuation of the valve 82 does not open the annulus control passageway 82.

Referring now to FIG. 3, it is to be noted that the tree connector 96 includes a hydraulic port 100 for supplying fluid from the well surface against the top of the sleeve valve 88 which performs as a piston between the exterior of the tubing hanger 80 and the interior of the tree connector 96. Application of hydraulic fluid through the port 100 moves the piston sleeve 88 further downwardly against the action of the spring 90 to open the annulus passageway 82 into communication with a port 102 in the Christmas tree connector 96 which port is suitably connected upstream for proper control and monitoring of the annulus. It is to be noted in the embodiment shown in FIGS. 1–3 that the annulus passageway 82 is not opened until after the tree connector 96 is secured to the wellhead 94 and that the annulus passageway 82 may be closed at any time by relieving the hydraulic pressure flowing into the port 100.

The present invention, therefore, is well adapted to carry out the objects and attain the ends and advantages mentioned as well as others inherent therein. While presently preferred embodiments of the invention are given for the purpose of disclosre, numerous changes in the details of construction and arrangement of parts will readily suggest themselves to those skilled in the art and which are encompassed within the spirit of the invention and the scope of the appended claims.

What is claimed is:

1. In a tubing hanger adapted to be supported in a wellhead and supporting tubing therefrom, the upper end of the hanger adapted to be engaged by a Christmas tree, the improvement comprising, a body including a plurality of control passageways, valve means connected to said control passageways for opening and closing said passageways, means yieldably urging said valve means to a closed position whereby the passageways will be closed when the body is installed in a wellhead, said valve means being exposed to the exterior of said body whereby the valve means may be actuated to the open position by means connected to the Christmas tree.

2. The apparatus of claim 1 wherein the valve means extend exteriorly of the body for contact by and mechanical actuation by the Christmas tree.

3. The apparatus of claim 1 wherein the valve means include piston means for actuation by fluid means connected to the Christmas tree.

4. The apparatus of claim 1 wherein the valve means include means extending exteriorly of the tubing hanger for mechanical actuation and includes piston means for actuation by fluid means.

5. The apparatus of claim 1 wherein the valve means and yieldably urging means include an annular sleeve surrounding the body and a spring urging the sleeve to a closed position.

6. A tubing hanger adapted to be supported in a wellhead for supporting tubing therefrom in a casing and forming an annulus between the tubing and casing, an upper end of the hanger adapted to be engaged by a Christmas tree, comprising, a body including an annulus control passageway adapted to communicate between the annulus and the Christmas tree, said body including a safety valve control passageway for controlling a subsurface safety valve, valve means connected to each of said passageways for opening and closing said passageways, means yieldably urging said valve means to a closed position whereby the passageways will be closed when the body is installed in the casing, and said valve means being exposed to the exterior of said body whereby the valve means may be actuated to the open position by means connected to the Christmas tree.

7. The apparatus of claim 6 wherein at least one of the valve means includes piston means for actuation by fluid means.

8. The apparatus of claim 6 wherein the Christmas tree includes, shoulder means for contacting and actuating at least one of said valve means to the open position when the Christmas tree engages the tubing hanger.

9. The apparatus of claim 6 wherein the valve means include means extending exteriorly of the body for mechanical actuation and includes piston means for actuation by fluid means.

* * * * *